US010626614B2

(12) United States Patent
Ness

(10) Patent No.: US 10,626,614 B2
(45) Date of Patent: Apr. 21, 2020

(54) MASONRY BLOCK WITH LEVELING PADS

(71) Applicant: Ness Inventions, Inc., St. Paul, MN (US)

(72) Inventor: Jeffrey A. Ness, Oak Park Heights, MN (US)

(73) Assignee: Ness Inventions, Inc., St. Paul, MN (US)

( * ) Notice: Subject to any disclaimer, the term of this patent is extended or adjusted under 35 U.S.C. 154(b) by 0 days.

(21) Appl. No.: 16/059,691

(22) Filed: Aug. 9, 2018

(65) Prior Publication Data

US 2019/0136533 A1 May 9, 2019

Related U.S. Application Data

(60) Provisional application No. 62/543,650, filed on Aug. 10, 2017.

(51) Int. Cl.

| | |
|---|---|
| ***E04C 5/16*** | (2006.01) |
| ***E04B 5/00*** | (2006.01) |
| ***E04C 1/39*** | (2006.01) |
| *E04B 2/02* | (2006.01) |

(52) U.S. Cl.

CPC ..... *E04C 5/168* (2013.01); *E04C 1/24* (2013.01); *E04C 1/395* (2013.01); *E04B 2002/0284* (2013.01)

(58) Field of Classification Search

CPC .. E04C 5/168; E04C 1/24; E04C 1/395; E04F 15/225; E04B 1/4178; E04B 2002/0284

USPC ..... 52/379, 403.1, 126.5, 592.5, 592.6

See application file for complete search history.

(56) References Cited

U.S. PATENT DOCUMENTS

| | | | | | |
|---|---|---|---|---|---|
| 3,534,518 | A * | 10/1970 | Zagray | F27B 9/26 | 52/258 |
| 4,026,086 | A * | 5/1977 | Langley | E04B 2/06 | 52/592.6 |
| 4,107,894 | A * | 8/1978 | Mullins | E04B 2/18 | 52/592.6 |
| 4,787,185 | A * | 11/1988 | Gascho | E04B 2/702 | 405/284 |
| 5,163,261 | A * | 11/1992 | O'Neill | B28B 7/0079 | 405/284 |
| 5,173,003 | A | 12/1992 | Hair | | |
| 5,337,527 | A * | 8/1994 | Wagenaar | E02D 29/025 | 405/284 |

(Continued)

*Primary Examiner* — Brian E Glessner
*Assistant Examiner* — Adam G Barlow
(74) *Attorney, Agent, or Firm* — Dicke, Billig & Czaja, PLLC

(57) ABSTRACT

A masonry block includes a top surface and an opposing bottom surface, a front surface and an opposing rear surface, a first side surface and an opposing second side surface, an x-direction defined as extending parallel to the rear and bottom surfaces between the first and second side surfaces, and a y-direction defined as extending perpendicular to the x-direction between the front and rear surfaces, and a set of three leveling pads disposed on the rear surface. The set of three leveling pads being positioned on the rear surface such that the three leveling pads provide four regions of overlap with leveling pads of two similar blocks in both block courses above and below the given block when the blocks are arranged in a running bond pattern, such that the four regions of overlap form four load transfer lines through each block in the wall.

3 Claims, 11 Drawing Sheets

(56) References Cited

U.S. PATENT DOCUMENTS 5,402,609 A * 4/1995 Kelley, Jr. ..... B28B 7/183 52/122.1
5,421,135 A 6/1995 Stevens et al.
5,471,808 A * 12/1995 De Pieri ..... E04B 2/18 446/128
5,490,363 A 2/1996 Woolford
5,493,816 A 2/1996 Willemsen
5,505,034 A * 4/1996 Dueck ..... E02D 29/025 405/286
5,535,568 A * 7/1996 Quinn ..... E02D 29/0266 405/284
5,560,173 A 10/1996 Scheiwiller
5,615,529 A * 4/1997 Johnson ..... A01G 9/28 52/604
5,651,642 A * 7/1997 Kelley, Jr. ..... E02D 29/025 405/284
5,832,687 A * 11/1998 Willemsen ..... A63H 33/04 52/592.6
5,866,026 A 2/1999 Johnston
5,934,037 A * 8/1999 Bundra ..... E04B 2/08 52/126.4
5,941,042 A * 8/1999 Dueck ..... E04C 1/395 405/286
5,951,210 A * 9/1999 Maguire ..... E02D 29/0225 405/284
6,050,044 A * 4/2000 McIntosh ..... A63H 33/082 446/124
6,226,951 B1 * 5/2001 Azar ..... E04B 2/16 52/604
6,233,897 B1 * 5/2001 Jurik ..... E04C 1/395 52/102
6,679,656 B1 * 1/2004 Manthei ..... E02D 29/0241 403/347
6,948,282 B2 9/2005 Bott
7,267,321 B1 * 9/2007 Morrell ..... B28B 7/0044 249/102
7,721,495 B2 * 5/2010 Kismarton ..... B29C 65/564 52/309.16
8,297,887 B2 * 10/2012 Ness ..... B28B 7/0041 405/286
8,863,464 B2 * 10/2014 Balducci, Jr. ..... E04B 2/46 52/592.6
2001/0019684 A1 * 9/2001 Manthei ..... E02D 29/025 405/284
2004/0134154 A1 * 7/2004 Bott ..... E04C 1/395 52/604
2007/0113510 A1 * 5/2007 Evereff ..... E04B 2/06 52/592.6
2011/0192097 A1 * 8/2011 Kelley, Jr. ..... E02D 29/0225 52/166
2012/0183362 A1 * 7/2012 Dawson ..... B28B 3/021 405/284
2015/0159371 A1 * 6/2015 Rodriguez Carassus ..... E04B 2/06 52/204.2
2015/0308114 A1 * 10/2015 Weber ..... E04C 1/40 52/592.6
2016/0032586 A1 * 2/2016 Radford ..... E04B 2/08 52/439

* cited by examiner

MASONRY BLOCK WITH LEVELING PADS

CROSS-REFERENCE TO RELATED APPLICATIONS

This Utility patent application is a non-provisional application of U.S. Ser. No. 62/543,650, filed Aug. 10, 2017, which is incorporated herein by reference.

BACKGROUND OF THE INVENTION

Concrete retaining wall blocks are used to build any number of landscape structures, including soil retention walls, for example. These structures are generally formed by stacking retaining wall blocks on top of one another in successive courses. During assembly of such retention or retaining walls, loose dirt often finds its way onto surfaces of the blocks. When the next course is placed on top of the already placed blocks, the presence of dirt or other debris may cause the lower surfaces of the blocks of the upper course to not be flush with the upper surfaces of the blocks of lower course. Also, the blocks may formed with a slight warp such that the upper and lower surfaces may not be planar but are slightly curved (e.g., the lower surface may be slightly convex).

The presence of dirt and/or warping may result in the upper and lower surfaces of the blocks not being flush or planar relative to one another, which can create undistributed or concentrated point loads on the blocks. Such loads can become large (e.g., depending an amount of weight being retained or on a height of an assembled wall). In some instances, such unevenly distributed loads may cause vertical cracks or break the retaining wall blocks, compromising the structural integrity of the retaining wall.

SUMMARY OF THE INVENTION

One embodiment provides a masonry block having a top surface, a bottom surface opposing the top surface, a front surface, a rear surface opposing the front surface, the front and rear surfaces extending between the top and bottom surfaces, a first side surface, a second side surface opposing the first side surface, the first and second side surfaces extending between the front and rear surfaces, and a set of three leveling pads extending from the rear surface. According to one embodiment, the set of three leveling pads being positioned on the rear surface such that the three leveling pads provide four regions of overlap with leveling pads of two similar blocks in both block courses above and below the given block when the blocks are arranged in a running bond pattern, such that the four regions of overlap form four load transfer lines through each block in the wall.

DESCRIPTION OF THE PREFERRED EMBODIMENTS

In the following Detailed Description, reference is made to the accompanying drawings which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of different implementations of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

The present disclosure describes a block and wall system that employs blocks having a set of three integral leveling pads either the upper or lower surface of the block which create a gap between successive courses of blocks in which errant dirt or debris may be present without adversely affecting contact between the successive courses of blocks and which provide contact points between successive courses of blocks even when a block is warped. The set of three leveling pads are arranged so that the three leveling pads provide four regions of vertical overlap with leveling pads of two similar blocks in block courses both above and below the given block when the blocks are arranged in a running bond pattern to form a wall structure, thereby forming four load transfer lines through the block. The set of three leveling pads form a 3-point leveling system and a 4-point load transfer arrangement (four load transfer lines extending through the block) that eliminates load stress points on the blocks when stacked to form structures, and thereby reduces the chance of blocks cracking and/or breaking due to uneven contact between blocks.

Figure 1:
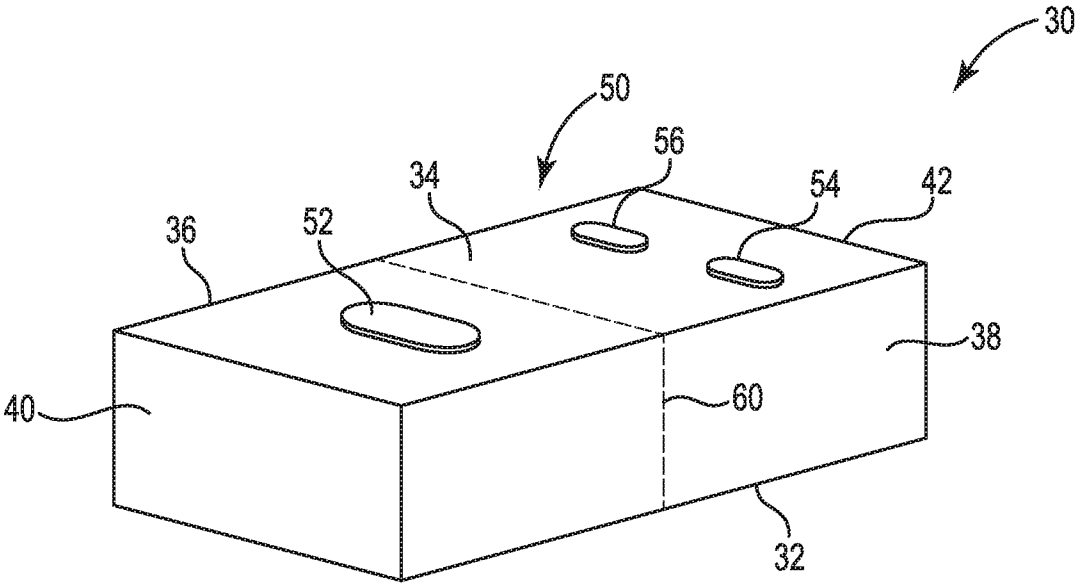
FIG. 1 is a perspective view of a block, according to one example.

FIG. 1 is a perspective view generally illustrating a masonry block 30 employing leveling pads according to one example of the present disclosure. Masonry block 30 includes a top surface 32 and an opposing bottom surface 34, a front surface 36 and an opposing rear surface 38, a first side surface 40 and an opposing second side surface 42. It is noted that block 30 is shown with top surface 32 facing down and rear surface 38 facing forward in FIG. 1. In one example, block 30 includes a set 50 of three leveling pads, indicated as leveling pads 52, 54, and 56, disposed on bottom surface 34, which together form a 3-point leveling and load distribution system for the block when the blocks are stacked in courses to form a structure. In one example, as will be illustrated in greater detail below, the set 50 of three leveling pads 52. 54, and 56 are arranged on a surface of block 30 such that when the blocks are arranged in courses having a running bond pattern to form a structure (e.g., a wall) the set 50 of leveling pads of a given block have four regions of vertical overlap with the leveling pads of two similar blocks in the course above the block, and have four regions of vertical overlap with the leveling pads of two similar blocks in the course below the block. The four regions of vertical overlap with the blocks in the block courses above and below a given block form four load transfer lines through the block via the set 50 of three leveling pads, thereby better distribution loads across the block while also providing block leveling.

Figure 2:
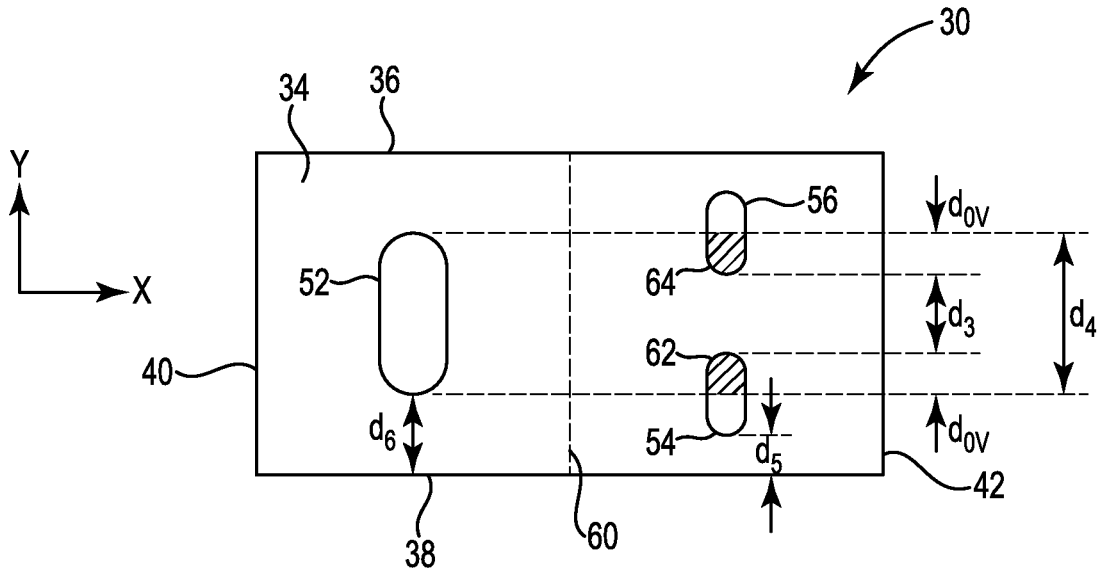
FIG. 2 is a top view of a block, according to one example.
Figure 3:
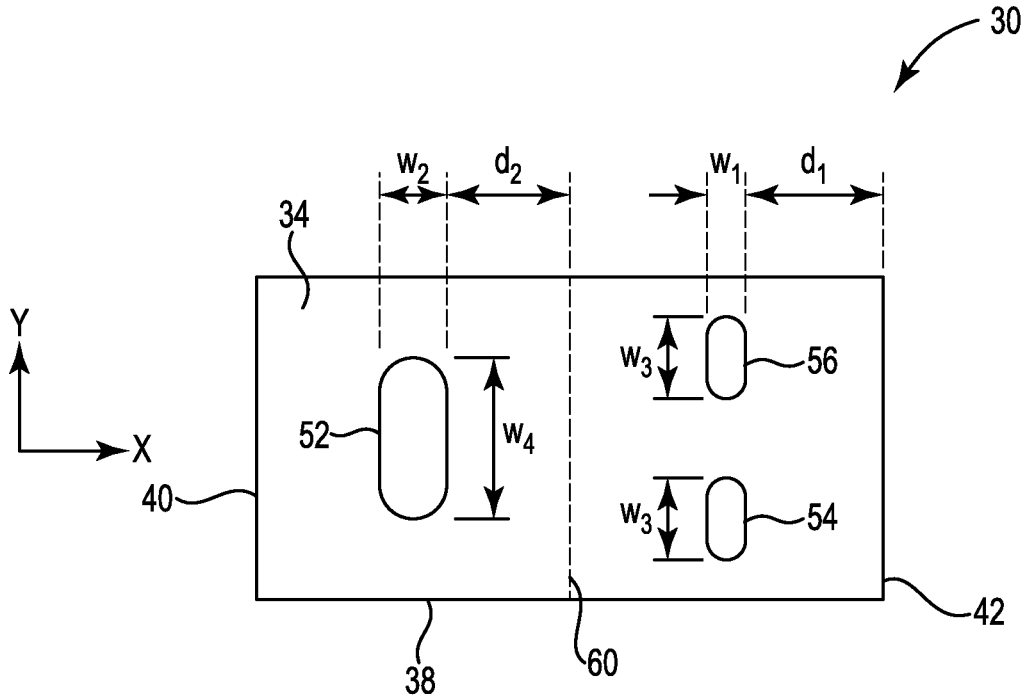
FIG. 3 is a top view of a block, according to one example.

In one example, a single leveling pad, illustrated as leveling pad 52 in FIG. 1, is disposed on a first half of block 30, relative to a centerline 60 extending between front and rear surfaces 36 and 38, and a pair of leveling pads, illustrated as leveling pads 54 and 56 in FIG. 1, are disposed on a second half of block 30. FIGS. 2 and 3 are top views of the block of FIG. 1 and illustrate positioning of leveling pads 52, 54, and 56, according to one example.

FIGS. 2 and 3 represent plan views generally illustrating bottom surface 34 of block 30, according to one example. With reference to FIG. 2, according to one example, leveling pad 52 has a dimension d4 (or width, w4, see FIG. 2) in the y-direction (e.g., front face 36 to rear face 38) that is at least equal to a separation distance d3 between leveling pads 54 and 54 plus two times a minimum desired overlap distance dov, with the set of leveling pads 50 being positioned so that leveling pad 52 overlaps each of the leveling pads 54 and 56 by the minimum overlap distance dov. It is noted that is it not necessary that the overlap distance with leveling pad 52 and leveling pads 54 and 56 be equal. A first edge of leveling pad 62 is a distance, d5, from rear surface 38, and a first edge of leveling pad 52 is a distance, d6, from rear surface 38.

With reference to FIG. 3, according to one example, a distance d1 of leveling pads 54 and 56 in a x-direction (e.g., from second side 42 to first side 40) is less than or equal to a distance d2 of leveling pad 52 from centerline 60 plus a width of w2 of leveling pad 52 minus the desired overlap distance dov, and a distance d1 plus a width w1 of level pads 54 and 56 must be greater than or equal to distance d2 plus the desired overlap distance dov ($d2+dov-w1 \leq d1 \leq d2+w2-dov$).

In one example, leveling pads 54 and 56 have a width, w3, in the y-direction, and leveling pad 52 has a width, w4, in the y-direction. In one example, distance d6 is equal to the sum of the distance d5 and the width w3 minus the overlap distance d0 ($d6=d5+w3-d0$). It is noted that the above formulas assume that the each of the widths w1 to w4 is at least equal to the minimum desired overlap distance. In one example, a minimum overlap distance is such that a number of pounds per square inch on a given overlap region does not exceed a selected level.

Arranging the set of leveling pads 52, 54, and 56 so as to have a minimum overlap distance results in overlap regions 62 and 64 being created vertically between leveling pads 52 and leveling pads 54 and 56 of blocks above and below block 30 when stacked courses in a running-bond pattern to form a structure, such that four contact points are formed to create four load-bearing paths through each block.

Figure 4:
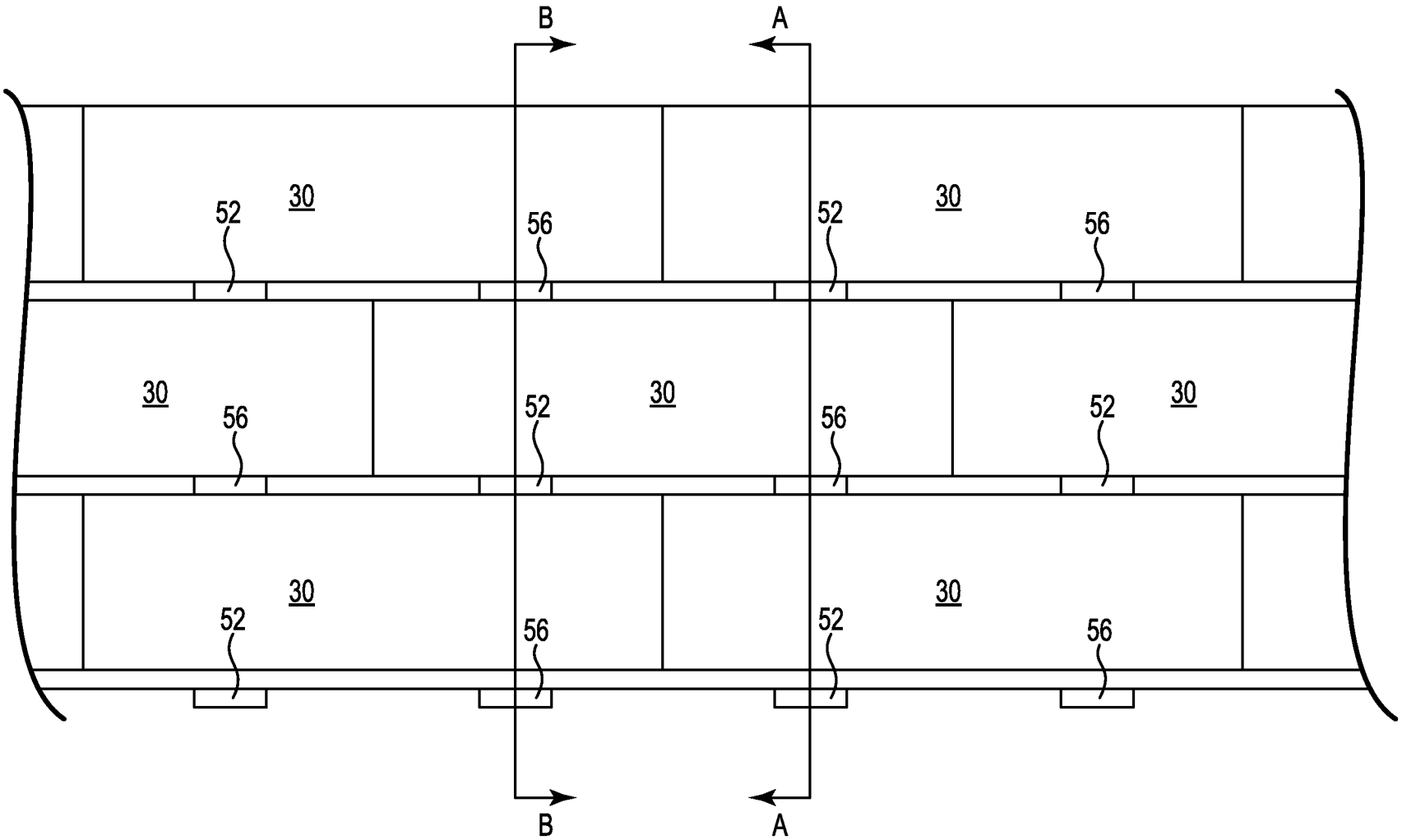
FIG. 4 is a front view of a wall structure, according to one example.
Figure 5:
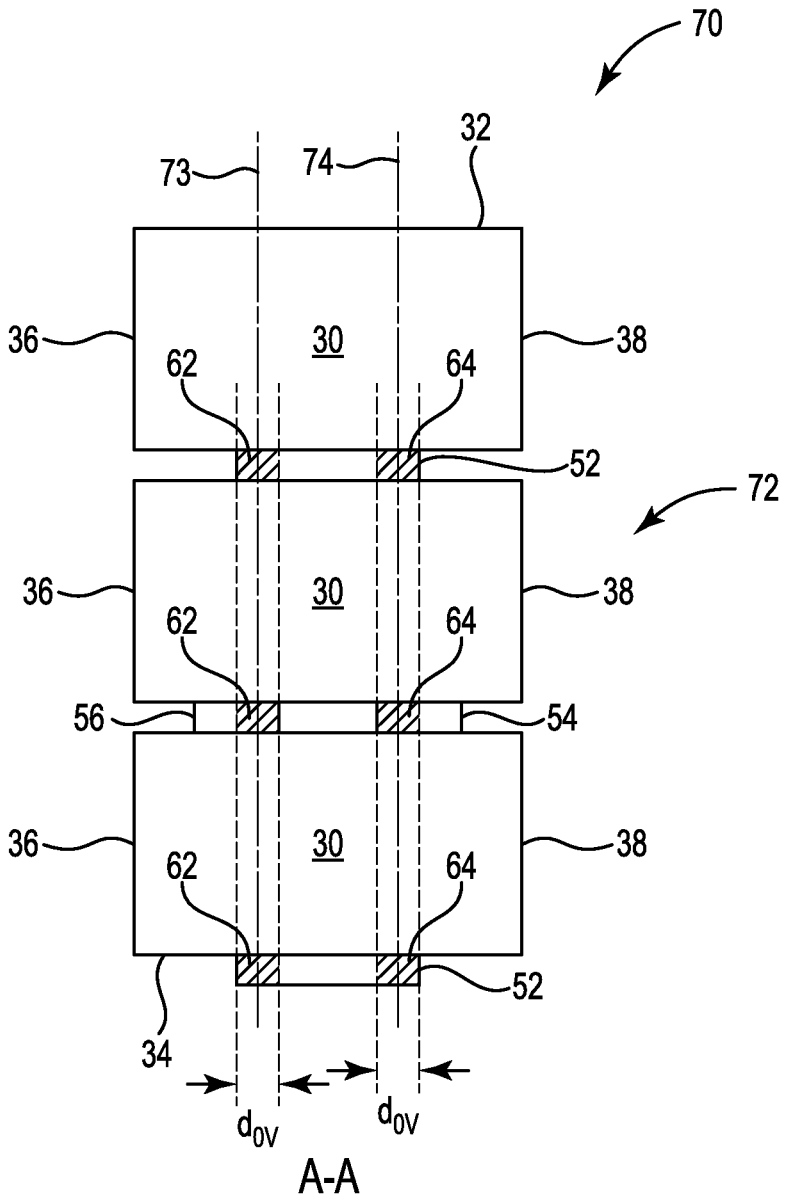
FIG. 5 is a sectional view of the wall structure of FIG. 4, according to one example.
Figure 6:
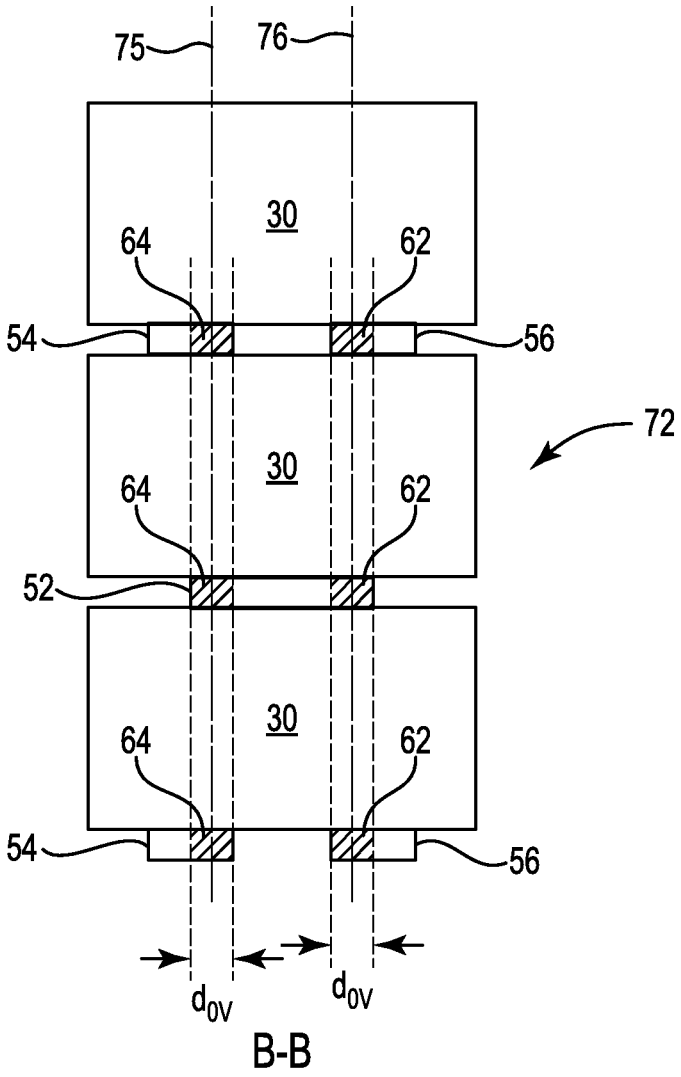
FIG. 6 is a sectional view of the wall structure of FIG. 4, according to one example.

FIGS. 4-6 illustrate an example wall structure 70 formed by stacking blocks 30 in successive courses. FIG. 4 is a front view illustrating a portion of wall structure 70 formed by assembling blocks 30 in using a running-bond pattern (i.e., each course of blocks is offset by half a block width from the underlying course). FIG. 5 is a sectional view (A-A in FIG. 4) and illustrates that leveling pads 54 and 56 of block 30 of middle course 72 each vertically overlap with portions of a leveling pad 52 in the course above and below the middle course 72 so as to form two load transfer lines 73 and 74 with the blocks in the courses above and below the block. FIG. 6 is a sectional view (B-B in FIG. 4) and illustrates that leveling pad 52 of block 30 of middle course 72 vertically overlaps with portions of leveling pads 54 and 56 of blocks 30 in both the course above and below the middle course 72 so as to form two load transfer lines 75 and 76 with the blocks in the courses above and below the block. As such, the set 50 of three leveling pads 52. 54, and 56 of block 30 in middle course 72 form a 3-point leveling system (contacts the blocks in the course below at three locations), but forms four vertical overlap regions with blocks in the course above and below so as to form four load-transfer lines to better distribute load through the block and avoid point load or concentrated load-points scenarios which might cause a block to crack or break.

Figure 7:
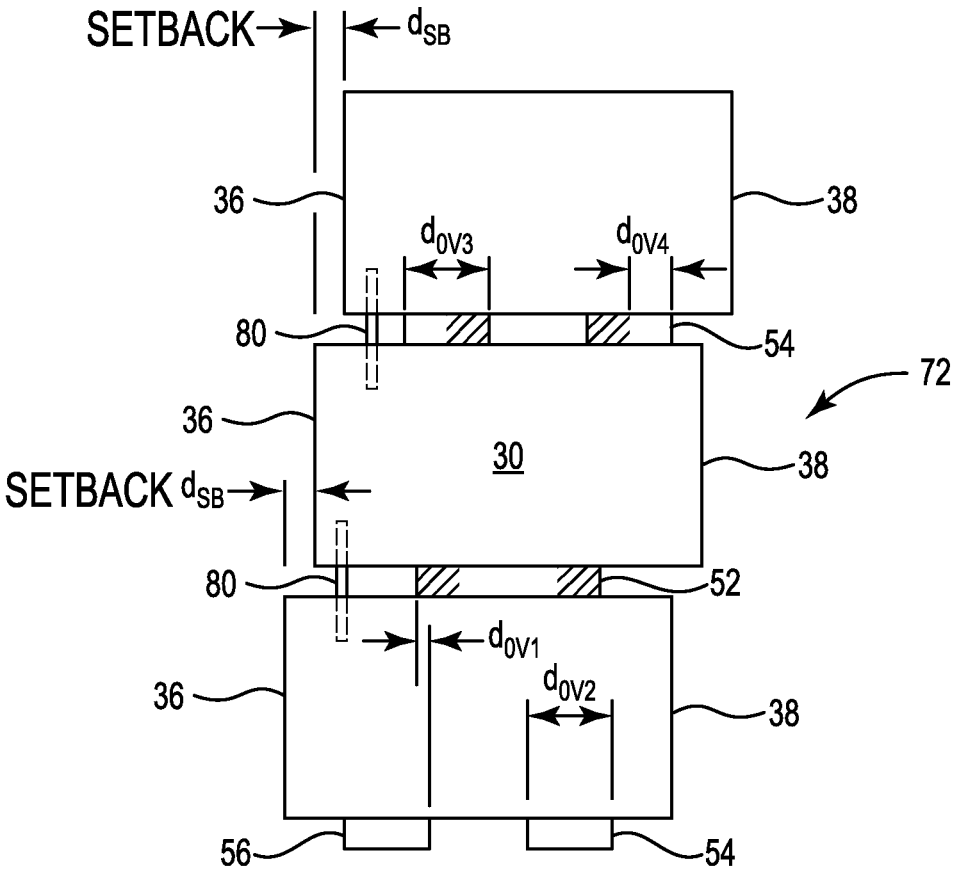
FIG. 7 is a sectional view of a wall structure, according to one example.

In one example, as illustrated by FIG. 7, blocks 30 may comprise retaining wall blocks, where each successive course is set-back from the preceding course of blocks by a setback distance dSB. In such case, the arrangement of the set 50 of three leveling pads 52, 54, and 56 must take into account the setback distance dSB so that the leveling pads 52, 54, and 56 achieve a minimum desired overlap with leveling pads of blocks in block courses above and below a given block so that four load transfer lines are created with blocks in a course below and that four load transfer lines are created with blocks in a course above each block. In one example, the retaining wall blocks are interlocked and a desired setback distance dSB formed via use of pins 80.

Figure 8:
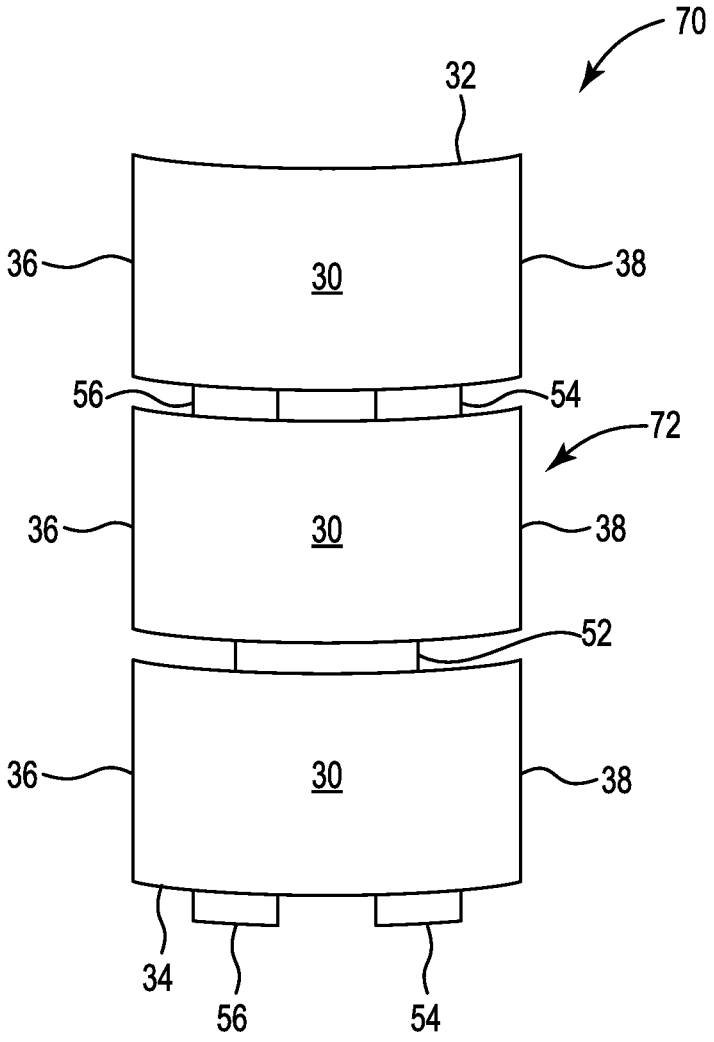
FIG. 8 is a sectional view of a wall structure, according to one example.

As illustrated by FIG. 8, the set of leveling pads 50 also eliminate point loads that might otherwise occur due to warping of the blocks during manufacture so that each block 30 is able to achieve 3-point loads with blocks in the lower course, and provide four overlap regions and, thus, four load transfer lines with blocks in both the lower and upper course of blocks. In one example, leveling pads 53, 54, and 56 each extend a minimum distance from the bottom surface 34, such as 0.093 inches, for example, in order to offset any potential warpage of the blocks that make occur during block manufacture and to ensure proper contact with blocks in the preceding course. Other suitable distances may be employed as a minimum extension distance for the leveling pads for a given block or block style.

Figure 9:
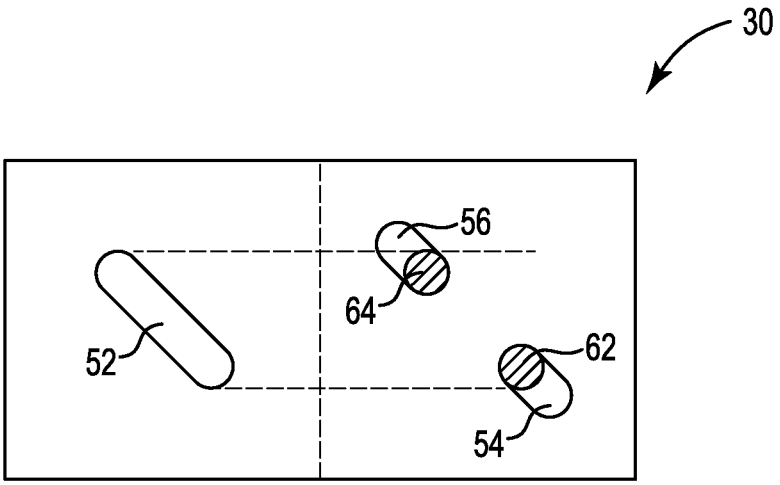
FIG. 9 is a top view of a block, according to one example.
Figure 10:
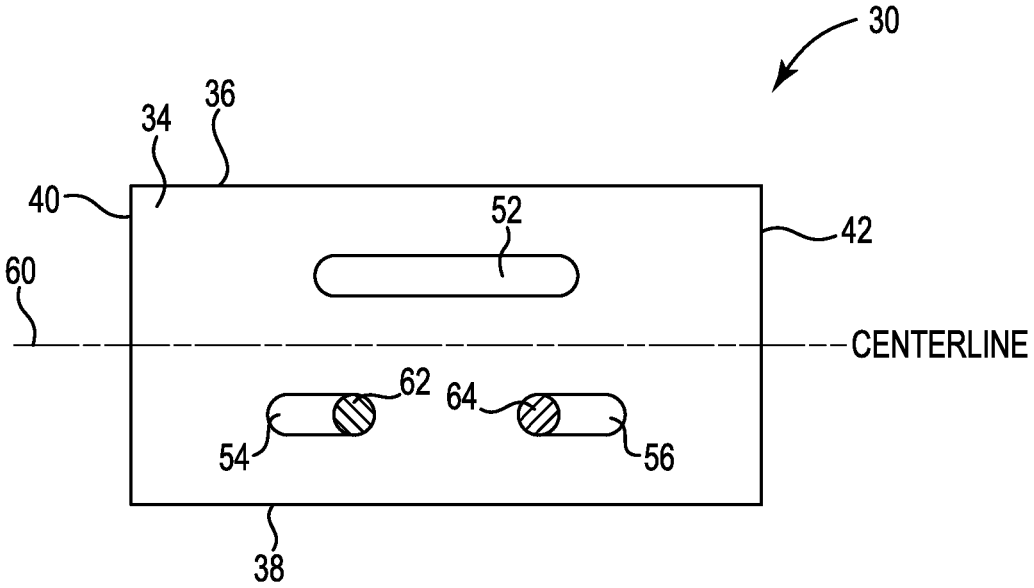
FIG. 10 is a top view of a block, according to one example.

It is noted that any suitable arrangement may be employed for the set 50 of leveling pads 52, 54, and 56 in addition to that illustrated by FIGS. 1-8, so long as the leveling pads 52, 54, and 56 vertically overlap with leveling pads of blocks of courses above and below a given block to form four overlap regions having a desired area of overlap (e.g., a minimum number of square inches of overlap for each overlap region). It is noted that the four overlap regions do not need to have equal overlap areas (square inches of overlap do not need to be the same, so long as each is at least has a minimum overlap area). For example, FIGS. 9 and 10 each illustrate different examples of arrangements that may be employed for the set 50 of leveling pads 52, 54, and 56.

Figure 11:
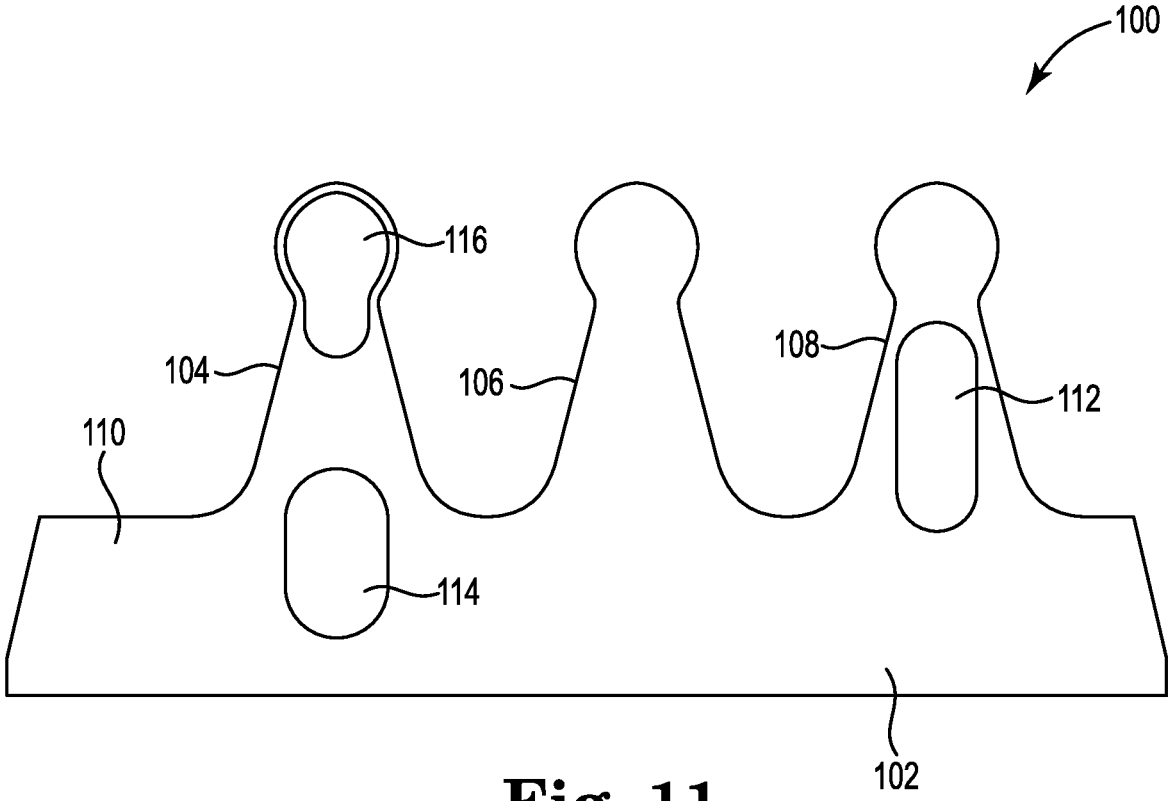
FIG. 11 is a top view of a block, according to one example.
Figure 12:
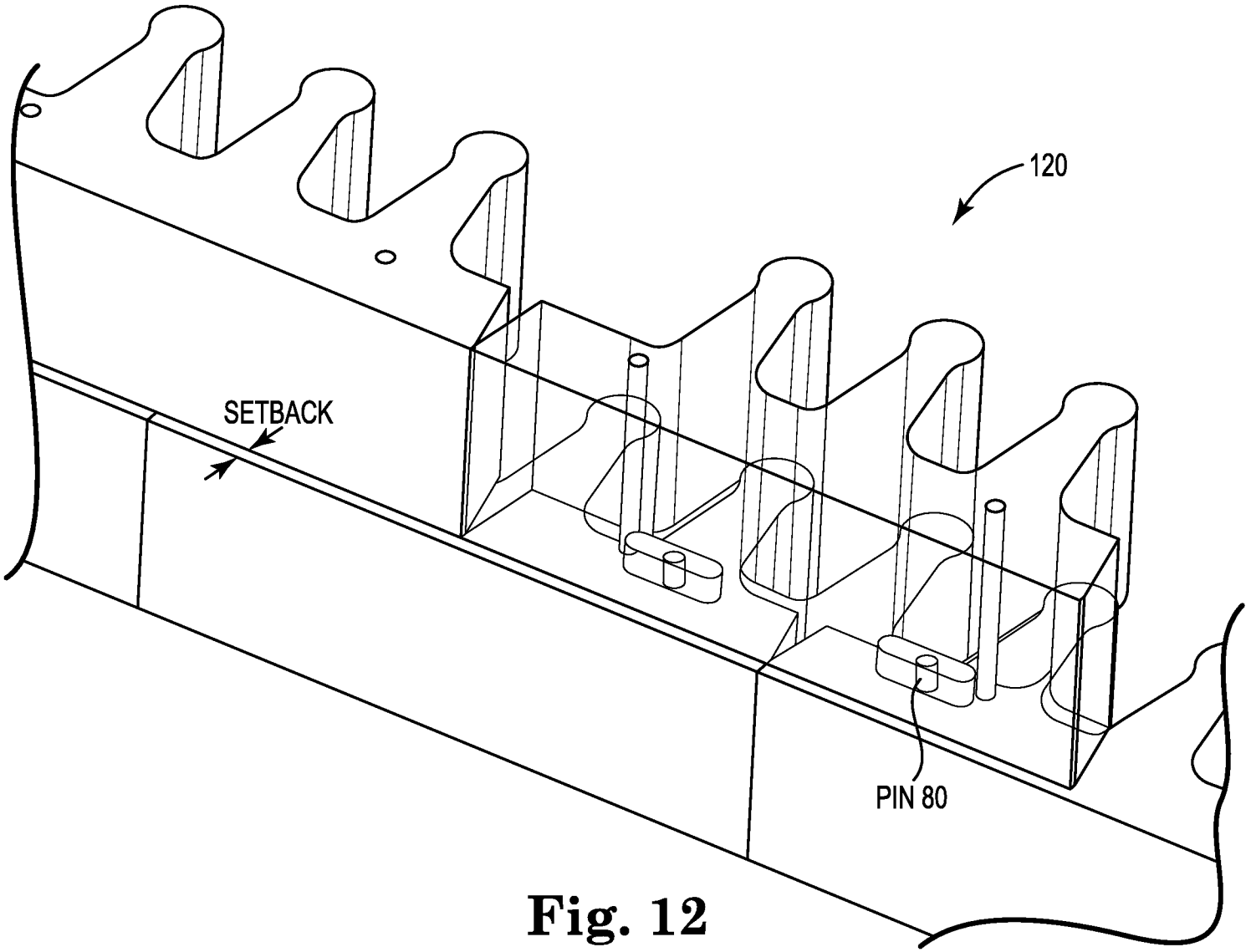
FIG. 12 is a perspective view of a wall structure employing a block of FIG. 11, according to one example.
Figure 13:
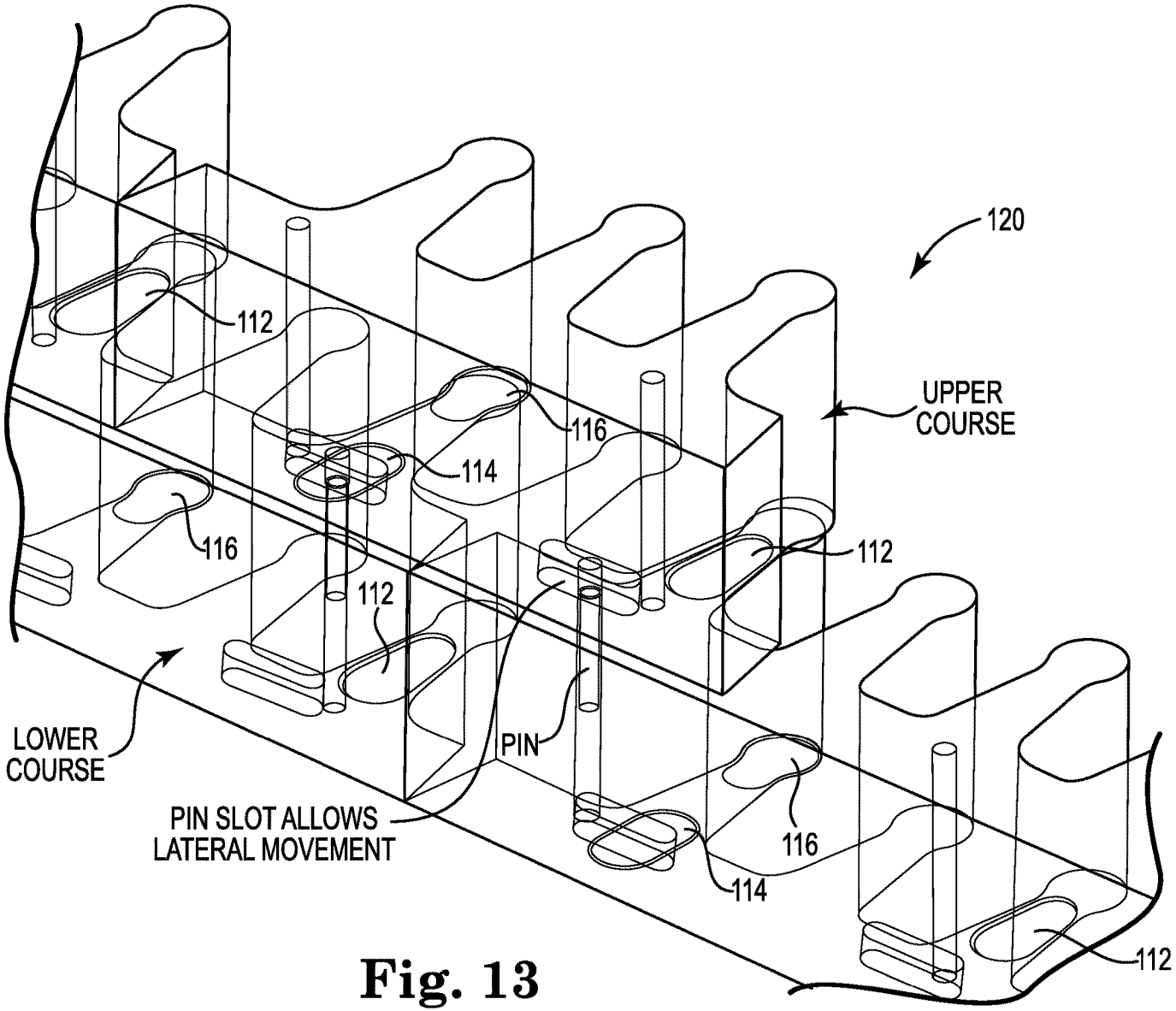
FIG. 13 is an isometric view of the wall structure of FIG. 12, according to one example.

FIG. 11 and FIGS. 12-13 respectively illustrate an example of a block 100 and a wall structure 120 formed using blocks 100 employing a set of three leveling pads, as described herein. FIG. 11 is bottom view of block 100, where block 100 is a retaining wall block having a front portion 102 with three legs 104, 108, and 108 extending from a rear side of front portion 102. Bottom side 110 includes a set of three leveling pads 112, 114, and 116. When stacked to form a retaining wall structure 120 having a running-bond pattern, as illustrated by FIG. 12, each successive course is set back by a set-back distance via a pin 80. As illustrated, the leveling pads 112, 114, and 116 overlap to form four overlap regions with blocks above and below the block. FIG. 13 is an isometric view of the wall structure 120 of FIG. 12.

From the above, it can be seen that any number of block and leveling pad configurations are possible. Additionally, although described in terms of off-set and alternating courses of blocks (a running bond pattern), it is noted that blocks and leveling pad configurations can be configured to enable vertical stacking of blocks without vertical and lateral offsets.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A masonry block comprising:

a top surface and an opposing bottom surface;

a front surface and an opposing rear surface;

a first side surface and an opposing second side surface, an x-direction defined as extending parallel to the rear and bottom surfaces between the first and second side surfaces, and a y-direction defined as extending perpendicular to the x-direction between the front and rear surfaces; and a set of three leveling pads disposed on the bottom surface including:

first and second leveling pads disposed on a first half of the block between a centerline extending in the y-direction and the second face, the first and second leveling pads having a first width in the x-direction; and a third leveling pad disposed on a second half of the block between the centerline and the first surface, the third leveling pad having a second width in the x-direction, the first and second widths at least equal to an overlap distance, first edges of the first and second leveling pads being at a first distance in the x-direction from the second side surface, and a first edge of the third leveling pad being at a second distance in the x-direction from the centerline toward the first side surface, the first distance being greater than or equal to a sum of the second distance and the overlap distance minus the first width, and the first distance being less than or equal to a sum of the second distance and the second width minus the overlap distance.

2. The masonry block of claim 1, wherein:

the first and second leveling pads have a third width, a first edge of the first leveling pad being a fifth distance in the y-direction from the rear face, and the first and second leveling pads being separated by a separation distance in the y-direction;

the third leveling pad has a fourth width in the y-direction, the fourth width being greater than or equal to the separation distance and twice the overlap distance, a first edge of the third leveling pad being a sixth distance in the y-direction from the rear surface, the sixth distance being equal to a sum of the fifth distance and third width minus the overlap distance.

3. A wall structure comprising courses of masonry blocks arranged in a running bond pattern, each masonry block including:

a top surface;

a bottom surface opposing the top surface;

a front surface;

a rear surface opposing the front surface, the front and rear surfaces extending between the top and bottom surfaces;

a first side surface;

a second side surface opposing the first side surface, the first and second side surfaces extending between the front and rear surfaces; and a set of three leveling pads extending from the rear surface, two of the leveling pads disposed on one half of the block between the first and second side surfaces and the third leveling pad disposed on the other half of the block, the set of three leveling pads being positioned such that the three leveling pads provide four regions of overlap with leveling pads of two similar blocks in both block courses above and below the block such that the four regions of overlap form four load transfer lines through each block in the wall.

* * * * *